US008722305B2

(12) United States Patent
Taikoji et al.

(10) Patent No.: US 8,722,305 B2
(45) **Date of Patent: *May 13, 2014**

(54) METHOD OF PREPARING CARRIER FOR ELECTROPHOTOGRAPHY

(75) Inventors: Masato Taikoji, Shizuoka (JP); Kousuke Suzuki, Shizuoka (JP); Shinichiro Yagi, Shizuoka (JP); Yuuki Mizutani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/425,675

(22) Filed: Mar. 21, 2012

(65) Prior Publication Data

US 2012/0264042 A1 Oct. 18, 2012

(30) Foreign Application Priority Data

Apr. 13, 2011 (JP) ..... 2011-088908

(51) Int. Cl.
*G03G 5/00* (2006.01)
*G03G 9/00* (2006.01)

(52) U.S. Cl.
USPC ..... 430/137.13; 430/111.3; 427/458

(58) Field of Classification Search
USPC ..... 430/111.1, 111.3, 111.31, 137.13; 427/458, 475
See application file for complete search history.

(56) References Cited

U.S. PATENT DOCUMENTS

| | | | | |
|---|---|---|---|---|
| 7,348,374 | B2 * | 3/2008 | Martinazzo | 524/431 |
| 2006/0134344 | A1 * | 6/2006 | Kitahata et al. | 427/458 |
| 2006/0228641 | A1 * | 10/2006 | Suzuki et al. | 430/111.32 |
| 2012/0008979 | A1 * | 1/2012 | Suzuki et al. | 399/111 |

FOREIGN PATENT DOCUMENTS

| | | |
|---|---|---|
| JP | 58-37654 | 3/1983 |
| JP | 5-341579 | 12/1993 |
| JP | 7-63933 | 3/1995 |
| JP | 7-120967 | 5/1995 |
| JP | 9-80951 | 3/1997 |
| JP | 9-304959 | 11/1997 |
| JP | 9-329910 | 12/1997 |
| JP | 2001-185338 | 7/2001 |
| JP | 2001-312093 | 11/2001 |
| JP | 2005-59379 | 3/2005 |
| JP | 2005-265887 | 9/2005 |
| JP | 2006-154453 | 6/2006 |
| JP | 2007-102159 | 4/2007 |
| JP | 2007-108684 | 4/2007 |
| JP | 2007-286078 | 11/2007 |
| JP | 2008-70837 | 3/2008 |
| JP | 2009-109676 | 5/2009 |
| JP | 2010-197663 | 9/2010 |
| JP | 2010-282168 | 12/2010 |

* cited by examiner

*Primary Examiner* — Stewart Fraser
(74) *Attorney, Agent, or Firm* — Oblon, Spivak, McClelland, Maier & Neustadt, L.L.P.

(57) ABSTRACT

A method of preparing a carrier for electrophotography, including a core material and a coating material layer formed on the surface of the core material, including:

coating the core material with the coating material; and burning the coating material with a high-frequency induction heater, wherein the core material has a saturated magnetization of from 40 to 95 $Am^2/kg$.

5 Claims, 1 Drawing Sheet

METHOD OF PREPARING CARRIER FOR ELECTROPHOTOGRAPHY

CROSS-REFERENCE TO RELATED APPLICATIONS

This patent application is based on and claims priority pursuant to 35 U.S.C. §119 to Japanese Patent Application No. 2011-088908, filed on Apr. 13, 2011, in the Japanese Patent Office, the entire disclosure of which is hereby incorporated herein by reference.

FIELD OF THE INVENTION

The present invention relates to a carrier and a developer for electrophotography, particularly to a carrier for electrophotography used for developing an electrostatic latent image to form a toner image.

BACKGROUND OF THE INVENTION

Electrophotographic image forming methods include forming an electrostatic latent image on an image bearer such as a photoconductive material, transferring a charged toner thereto to form a visible image (toner image), transferring the toner image onto a recording medium such as paper, and fixing the toner image thereon to form a final output image. Recently, electrophotographic copiers and printers are rapidly developing from monochrome to full-color, and full-color markets are expanding.

The electrophotographic image forming methods typically include overlaying three primary color toners, i.e., yellow, magenta, and cyan toners, or four color toners including the previous three and black toner, to reproduce all colors. Therefore, to produce a sharp full-color image having good color reproducibility, the surface of a fixed toner image has to be smooth to reduce light scattering. This is why many conventional full-color copiers produce images having medium to high glossiness of from 10 to 50%.

As a method of fixing a dry toner image on a recording medium, contact heat fixing methods using a heated roller or a heated belt having a smooth surface are typically used. Although the methods have high heat efficiency and are capable of fixing at high speed and imparting gloss and transparency to color toners, offset problems do occur, wherein a part of a toner image adheres to a fixing member and transfers to another image occur during separation of the fixing member from the melted toner image after pressing the surface of the fixing member.

For the purpose of preventing offset problems, the surface of the fixing member has typically been coated with silicone rubber or a fluorine-containing resin. Further, a releasing agent in the form of an oil such as silicone oil is applied to the surface of the fixing member. Although this approach is quite effectively used to prevent offset problems, a release oil applicator is required and the resultant fixer becomes larger. Therefore, as an alternative, there are oilless arrangements using a monochrome toner having high viscoelasticity when melted so as not to break down internally, wherein the molecular weight distribution of a binder resin of the toner is controlled, and further including a release agent such as wax, or systems that apply only a small amount of oil.

In addition, even full-color image forming apparatuses are becoming oilless as well for the purpose of being downsized and simplified. However, as mentioned above, to improve color reproducibility of a color toner, the color toner needs to have lower viscoelasticity because the fixed color toner image is required to have a smooth surface. Therefore, the color toner has offset problems more often than the monochrome toner does, making it more difficult to make a fixer oilless or use only a small amount of oil. In addition, a toner including a release agent has higher adherence to an image bearer and lower transferability to a transfer paper. Further, the release agent therein contaminates friction-charged members such as a carrier and lowers the chargeability thereof, resulting in deterioration of durability of the toner.

In proportion to increase of demand for faster and prettier image formation, a developer including a carrier and a toner receives significantly more stress. Even the carrier conventionally having a long life is becoming more difficult to have a sufficient life.

Further, the carrier are having smaller particle diameter to produce higher quality images, which is largely effective for producing high-definition images but also causes many adverse effects. One of them is deterioration of storage stability in an environment of high temperature and high humidity, e.g., a developer is solidified, i.e., a carrier and a toner, carriers themselves, or toners themselves adhere to each other to form an agglomerate. When a brand new developer is set in a developing unit, ordinarily it falls therein with ease. However, a solidified developer does not, and even when fed therein, the solidified developer remaining therein is stuck with a regulation plate regulating an amount of the developer on a developing roller, resulting in production of abnormal images. When solidified in the developing unit or placed therein from the beginning without a case containing the developer and too solidified to break with an agitation blade therein, abnormal images are produced or the unit is not drivable.

This is partly because both of the carrier and the toner increase their specific surface area with smaller particle diameters, and partly because of low-temperature fixability and oilless. In addition, the developing unit becomes smaller with smaller machine and the developer is difficult to fall, and problems tend to occur when the developer is solidified. With variation of the market, a guaranteed environment needs to be wider and a developer is actually required to have more strict quality.

In order to solve this problem, Japanese published unexamined application No. 2006-154453 discloses a method of increasing a temperature of burning a resin-coated carrier in an electric oven. However, the resin tends to become black with high temperature, resulting in production of contaminated color images.

Thus, the solidification of the developer is thought a serious problem from now. Toner solidifications are conventionally disclosed in Japanese published examined application No. 2-51177 and Japanese published unexamined applications Nos. 9-304959, 9-329910 and 2001-312093. However, they are all about toners only, not about solidification of a developer including a toner and a carrier.

Japanese published unexamined applications Nos. 2007-102159 and 2008-70837 disclose a carrier for electrophotography including particles each having a particle diameter larger than the thickness of the coated layer of the carrier. Further, Japanese published unexamined application No. 2007-286078 discloses a developing method feeding the toner and carrier to an image developer while discharging an extra developer in the image developer.

Demand for faster and prettier image formation is increasing, and the developing roller rotates faster and a centrifugal force applied to the developer is increasing as well. Further, each of the carrier and the toner is required to have a smaller particle diameter to produce higher quality images.

Therefore, the particle diameter does not affect the centrifugal force if magnetizations of the carriers are same (the magnetization per weight is same). However, the smaller the particle diameters of the toner and the carrier, the specific surface area per weight increases, resulting in a charge quantity larger than the magnetization. Namely, the carrier is electrically attracted to a photoreceptor to adhere thereto.

However, effects of the above-mentioned conventional arts against initial carrier adherence, solidification, color contamination and abrasion are insufficient.

Because of these reasons, a need exists for a method of preparing a carrier without initial adherence, and having good anti-solidification, anti-color contamination and abrasion resistance.

SUMMARY OF THE INVENTION

Accordingly, an object of the present invention is to provide a method of preparing a carrier for electrophotography without initial adherence, and having good anti-solidification, anti-color contamination and abrasion resistance.

Another object of the present invention is to provide a carrier prepared by the method.

A further object of the present invention is to provide a developer including the carrier.

These objects and other objects of the present invention, either individually or collectively, have been satisfied by the discovery of a method of preparing a carrier for electrophotography, comprising a core material and a coating material layer formed on the surface of the core material, comprising:

coating the core material with the coating material; and burning the coating material with a high-frequency induction heater, wherein the core material has a saturated magnetization of from 40 to 95 $Am^2/kg$.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
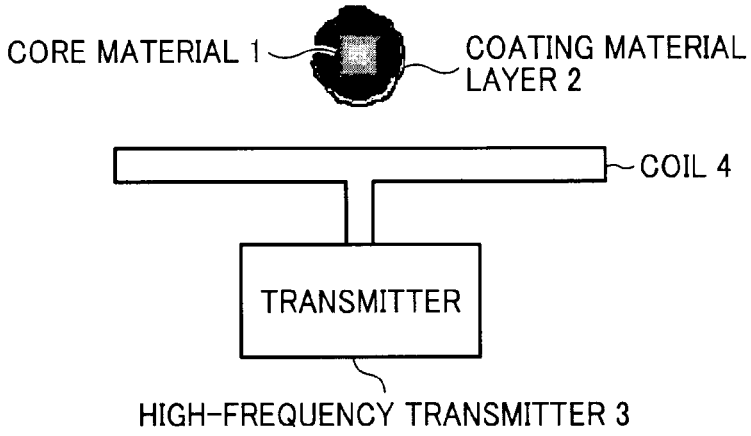
FIG. 1 is a schematic view illustrating a high-frequency induction heater in the present invention.

The present invention provides a method of preparing a carrier for electrophotography without initial adherence, and having good anti-solidification, anti-color contamination and abrasion resistance.

More particularly, the present invention relates to a method of preparing a carrier for electrophotography, comprising a core material and a coating material layer formed on the surface of the core material, comprising:

coating the core material with the coating material; and burning the coating material with a high-frequency induction heater, wherein the core material has a saturated magnetization of from 40 to 95 $Am^2/kg$.

Namely, the high-frequency induction heater generates an alternating magnetic field from a conductive wire a high-frequency current runs through, causing a loss of the metallic core material such as a hysteresis loss and an eddy current loss to heat the core material, which dries a solvent remaining in a coated layer and crosslinks the coating material. Therefore, the high-frequency induction heater can heat a coated layer of each of the carrier particles from the inside such that the solvent easily goes out of the coated layer to lower the remaining solvent.

On the contrary, burners such as conventional electric ovens and rotary kilns heat the core material coated with a coating material from the outside. Therefore, the coated layer is dried or crosslinked from the outside, and the solvent remaining inside is difficult to go out, resulting in difficulty of lowering the remaining solvent. Further, layered carriers are heated from the outside, resulting in slow heating speed.

As microscopic bubbles of solvent vapors elevate to the surface in the coated layer while dried, they are associating with each other or swollen with heat, and the enlarged bubbles break the surface of the coated layer and discharged as a gas. As the coated layer is dried, it becomes harder to be a barrier and the solvent is more difficult to dry. Therefore, it is difficult to completely deaerate the solvent remaining in a small amount. This means it is preferable to pass the bubbles while the outermost surface layer is still soft, i.e., to deaerate more quickly in order to increase efficiency of drying the solvent. In the present invention, not only the resin-coated layer is quickly heated, but also heated from the inside to pass the solvent remaining inside (bubbles) while the outermost surface layer is still soft. Therefore, the solvent can more quickly and sufficiently be dried.

Meanwhile, since the high-frequency induction heater can heat a coated layer of each of the carrier particles from the inside, all the coated layers are equally heated and uniformly crosslinkable. On the contrary, since the burners such as conventional electric ovens and rotary kilns heat the layered carriers from the outside, the carrier located near a heat source (outside) can have a desired amount of heat, but the carrier located far from the heat source (inside) cannot have a desired amount of heat because a heat is difficult to transfer. Therefore, it is difficult to uniformly crosslink the coated layers of all the carrier particles.

The solvent and uncrosslinked coating materials remaining in the coated layer are disadvantageous for preventing solidification of a carrier and a toner, carriers themselves and toners themselves when stored, particularly at high humidity, and noticeably deteriorate storage stability thereof.

In order to improve the storage stability, the burning temperature is conventionally increased, but which is disadvantageous for preventing color contamination. Particularly in full-color image formation, it cannot but find an acceptable compromise between the solidification and the color contamination.

Since the high-frequency induction heater efficiently dries the coated layer and crosslinks as mentioned above, the coated layer can be dried at lower burning temperature. Further in crosslinking reaction, conventionally, carrier particles at the surface of a carrier layer are excessively heated to heat carrier particles inside. However, the high-frequency induction heater can uniformly heat the carrier particles at low burning temperature, and which effectively prevents color contamination.

A saturated magnetization of the core material heated by the high-frequency induction heater and a maximum temperature of heating the core material have a relation each other. As mentioned above, the alternating magnetic field from a conductive wire a high-frequency current runs through repeatedly magnetizes the core material (hysteresis loss), and a core material having a large saturated magnetization is heated at high speed and has high maximum heatable temperature. However, when a carrier formed of a core material having a saturated magnetization greater than 95 $Am^2/kg$ is burned by a high-frequency induction heater, the carrier quickly deteriorates in magnetization and the initial carrier adherence increases. The carrier particles having low magnetization after burned increase unevenness of magnetization among all of the carrier particles, and cause carrier adherence. The low magnetization of the carrier can be recognized by measuring a magnetization of the carrier collected by the cleaning blade. It is thought that quick heating breaks the organization of the core material and the magnetization thereof deteriorates.

In addition, quick heating worsens color contamination. It is thought that materials coated on the core material are colored with heat and color contamination worsens.

When a carrier formed of a core material having a saturated magnetization less than 40 $Am^2/kg$ is burned by a high-frequency induction heater, the core material is not efficiently heated and the coating materials are not sufficiently crosslinked. Further, a residual solvent is difficult to leave and decrease.

The high-frequency induction heating of the present invention is a heating method typically called as induction heating, electromagnetic induction heating, IH, etc. As mentioned above, the high-frequency induction heater directly heats a metal without an intermediate and has very high energy efficiency.

FIG. 1 is a schematic view illustrating a high-frequency induction heater in the present invention, in which a high-frequency current provided from a high-frequency transmitter 3 runs through a coil 4 to generate a magnetic flux, a core material 1 coated with coating materials 2 generates an eddy current with the magnetic flux to produce a heat, and the coating materials are crosslinked with the heat.

The saturated magnetization in the present invention us a maximum magnetization of a core material at 10 kOe when measured by VSM-C7-10 from Toei Industry Co., Ltd. A sample placed in a uniform magnetic field is oscillated at a constant frequency and a constant amplitude, and an electromotive force induced to a detection coil placed around the sample is measured. The magnetization of the sample is determined from a relation between the electromotive force and the magnetization.

The solidification in the present invention means phenomena where a carrier and a toner, carriers themselves and toners themselves adhere to each other, particularly under an environment of high temperature and high humidity, and noticeably under an environment of high humidity. When a developer is solidified in a developing unit, the solidified developer remaining therein is stuck with a regulation plate regulating an amount of the developer on a developing roller, resulting in production of abnormal images such as white stripe images. When the developer is too solidified to break with an agitation blade therein, the unit is not drivable.

The color contamination in the present invention is a defective color image having poor color reproducibility because a small amount of a scraped coated film of a developer (carrier) is mixed in toner when stirred in a developing unit. Even a small amount of the scraped coated film of the carrier largely influences on colors, particularly on yellow images. It is notable here that there is a large difference between conventional color contamination level and that in the present invention.

Specifically, a stress to a developer noticeably increases with recent high-speed printing, and conventionally-used carriers are not usable anymore. Further, demands for colors are becoming more strict and conventionally-allowed color contamination level is not allowable anymore.

The core material is preferably formed of magnetite because of having a large saturated magnetization, and therefore it is quickly heatable and has a high maximum heatable temperature.

As mentioned above, a coated layer of each of the carrier particles can be heated from the inside such that the solvent easily goes out of the coated layer to lower the remaining solvent, which is advantageous for preventing solidification. In addition, all the coated layers are evenly heated and sufficiently crosslinked, which is thought to improve abrasion resistance thereof against stress.

In addition, the core material is preferably formed of Mn—Mg ferrite because of having a large saturated magnetization, and therefore it is quickly heatable and has a high maximum heatable temperature.

As mentioned above, a coated layer of each of the carrier particles can be heated from the inside such that the solvent easily goes out of the coated layer to lower the remaining solvent, which is advantageous for preventing solidification. In addition, all the coated layers are evenly heated and sufficiently crosslinked, which is thought to improve abrasion resistance thereof against stress.

Further, the core material is preferably formed of Mn ferrite because of having a large saturated magnetization, and therefore it is quickly heatable and has a high maximum heatable temperature.

As mentioned above, a coated layer of each of the carrier particles can be heated from the inside such that the solvent easily goes out of the coated layer to lower the remaining solvent, which is advantageous for preventing solidification. In addition, all the coated layers are evenly heated and sufficiently crosslinked, which is thought to improve abrasion resistance thereof against stress.

Furthermore, the core material is preferably formed of Cu—Zn ferrite because of having a large saturated magnetization, and therefore it is quickly heatable and has a high maximum heatable temperature.

As mentioned above, a coated layer of each of the carrier particles can be heated from the inside such that the solvent easily goes out of the coated layer to lower the remaining solvent, which is advantageous for preventing solidification. In addition, all the coated layers are evenly heated and sufficiently crosslinked, which is thought to improve abrasion resistance thereof against stress.

Resins forming the coated layer of the carrier of the present invention include, but are not particularly limited to, if typically used for the carrier such as silicone resins, fluorine-containing resins and acrylic resins. These resins can be used alone or in combination, and can also be modified.

Specific examples of the core material for the carrier of the present invention include, but are not limited to, known carriers for electrophotographic two-component developers, such as iron, ferrite, magnetite, hematite, cobalt, Mn—Mg—Sr ferrite, Mn ferrite, Mn—Mg ferrite, Li ferrite, Mn—Zn ferrite, Cu—Zn ferrite, Ni—Zn ferrite and Ba ferrite, which can be selected in accordance with usage.

The following is an example of methods of preparing the carrier of the present invention, but the methods thereof are not limited thereto.

This is an outline of a method of preparing the carrier.

Measurement of materials→dispersing a coating liquid→coating→burning→sifting

Namely, materials measured to have desired ratios are dispersed by a disperser to prepare a dispersion. Specific examples of the disperser include any typically-used dispersers such as homomixers, rotary blade dispersers (Ebara Milder, Cavitron, etc.) and beads mill. The dispersion is coated on the surface of the core material by a coater to form a coated layer thereon. Specific examples of the coaters include any typically-used coaters such as rolling fluidized bed using a spray and a method of dipping the core material in the dispersion and drying the solvent. The coated layer is burned to dry and promote crosslinking reaction. Specific examples of the burners include any typically-used burners such as electric ovens and rotary kilns. Finally, the agglomerated particles after burned are broken. Specific examples of the breaker include any sifters if particles are sifted to each one peace, such as vibration shifters and ultrasonic vibration sifters. Further, the sifter not only breaks he agglomerated particles but also removes coarse or foreign particles.

Thus, the carrier particles of the present invention are prepared. This is just an example of the methods of preparing them, and the methods are not limited thereto.

The color toners in the present invention include not only singularly-used color toners but also a black toner in addition to a yellow toner, a magenta toner, a cyan toner, a red toner, a green toner, a blue toner, etc. used for full-color images. Further, conventional toners regardless of monochrome toners, color toners and full-color toners can be used in the present invention, such as toners prepared by pulverization methods and polymerization methods.

Further, an oilless toner including a release agent can also be used. The release agent tends to transfer to a carrier, but the carrier of the present invention well prevents the release agent from transfer thereto, and produces quality images for long periods. Particularly, the carrier of the present invention is preferably used with an oilless full-color toner including a soft binder resin.

Specific examples of the binder resin for use in the toner include known resins, e.g., a monomer of styrene and its derivative such as polystyrene, poly-p-styrene and polyvinyltoluene; a styrene copolymer such as styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer; poly(methyl methacrylate), poly(butyl methacrylate), polyvinylchloride, polyvinyl acetate, polyethylene, polyester, polyurethane, epoxy resin, polyvinyl butyral, poly(acrylic acid), rosin, modified rosin, terpene resin, phenolic resin, aliphatic or aromatic hydrocarbon resin, aromatic petroleum resin etc. These can be used alone or in combination.

Specific examples of the binder resin for pressure-fixing include known resins, e.g., polyolefin such as low-molecular weight polyethylene and low-molecular weight polypropylene; olefin copolymer such as ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer and ionomer resin; epoxy resin, polyester, styrene-butadiene copolymer, polyvinylpyrrolidone, methyl vinyl ether-anhydrous maleic acid copolymer, maleic acid-modified phenolic resin, phenol-modified terpene resin etc. These can be used alone or in combination, but the resins are not limited thereto.

The toner for use in the present invention may include a fixing aid besides the binder resin, a colorant and a charge controlling agent. This is why the toner can be used in an oilless system having a fixing system not applying an oil on a fixing roller such that a toner does not adhere thereto. Specific examples of the fixing aid include, but are not limited to, polyolefin such as polyethylene and polypropylene, fatty acid metal salt, fatty acid ester, paraffin wax, amide wax, polyhydric wax, silicone varnish, carnauba wax and ester wax etc.

Specific examples of the colorants include known pigments and dyes capable of forming yellow, magenta, cyan and black toners. Specific examples of yellow pigment include, but are not limited to, cadmium yellow, mineral fast yellow, nickel titanium yellow, Naples yellow, naphthol yellow S, Hansa yellow G, Hansa yellow 10G, benzidine yellow GR, qunoline yellow lake, permanent yellow NCG and tartrazine lake.

Specific examples of orange pigments include, but are not limited to, molybdenum orange, permanent orange GTR, pyrazolone orange, Vulcan orange, indanthrene brilliant orange RK, benzidine orange G and indanthrene brilliant orange GK.

Specific examples of red pigments include, but are not limited to, iron red, cadmium red, permanent red 4R, lithol red, pyrazolone red, watching red calcium salt, lake red D, brilliant carmine 6B, eosin lake, rhodamine lake B, alizarin lake and brilliant carmine 3B.

Specific examples of violet pigments include, but are not limited to, fast violet B and methyl violet lake.

Specific examples of blue pigments include, but are not limited to, cobalt blue, alkali blue, Victoria blue lake, phthalocyanine blue, non-metal phthalocyanine blue, phthalocyanine blue-partly chloride, fast sky blue and indanthrene blue BC.

Specific examples of green pigments include, but are not limited to, chromium green, chromium oxide, pigment green B and malachite green lake.

Specific examples of black pigments include, but are not limited to, carbon black, oil furnace black, channel black, lamp black, acetylene black, an azine color such as aniline black, metal salt azo color, metal oxide, complex metal oxide.

These colorants can be used alone or in combination.

The toner may further include a charge controlling agent when necessary. The charge controlling agent is not particularly limited, and nigrosine; an azine dye having an alkyl group having 2 to 16 carbon atoms(see Japanese Examined Patent Publication No. 42-1627); a basic dye such as C.I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040) and C. I. Basic Green 4 (I. C. 42000); and a lake pigment of these basic dyes; a quaternary ammonium salt such as C. I. Solvent Black 8 (C. I. 26150), benzoylmethylhexadecylammonium chloride and decyltrimethyl chloride; a dialkyltin compound such as dibutyl and dioctyl; a dialkyltin borate compound; a guanidine derivative; a polyamine resin such as vinyl polymer having an amino group and condensation polymer having an amino group; a metal complex salt of monoazo dye described in Japanese Examined Patent Publication No. 41-20153, 43-27596, 44-6397 and 45-26478; salicylic acid described in Japanese Examined Patent Publication No. 55-42752 and 59-7385; a metal complex with Zn, Al, Co, Cr, Fe etc. of dialkylsalicylic acid, naphthoic acid and dicarboxylic acid; a sulfonated copper phthalocyanine pigment; organic boron acid slats; fluorine-containing quaternary ammonium salt; calixarene compound etc. can be used. For a color toner besides a black toner, a charge controlling agent impairing the original color should not be used, and white metallic salts of salicylic acid derivatives are preferably used.

The toner optionally includes an external additive. Specific examples thereof include inorganic particulate materials such as silica, titanium oxide, alumina, silicon carbonate, silicon nitride and boron nitride; and particulate resins. These are externally added to mother toner particles to further improve transferability and durability thereof. This is because these external additives cover a release agent deteriorating the transferability and durability of a toner and the surface thereof to decrease contact area thereof The inorganic particulate materials are preferably hydrophobized, and hydrophobized particulate metal oxides such as silica and titanium oxide are preferably used. The particulate resins such as polymethylmethacrylate and polystyrene fine particles having an average particle diameter of from 0.05 to 1 μm, which are formed by a soap-free emulsifying polymerization method, are preferably used.

Further, a toner including the hydrophobized silica and hydrophobized titanium oxide as external additives, wherein an amount of the hydrophobized silica is larger than that of the hydrophobized titanium oxide, has good charge stability against humidity. A toner including and external additives having a particle diameter larger than that of conventional external additives, such as a silica having a specific surface area of from 20 to 50 $m^2/g$ and particulate resins having an average particle diameter of from 1/100 to 1/8 to that of the toner besides the inorganic particulate materials, has good durability.

This is because the external additives having a particle diameter larger than that of the particulate metal oxides prevent the particulate metal oxides from being buried in mother toner particles, although tending to be buried therein while the toner is mixed and stirred with a carrier, and charged in an image developer for development.

A toner internally including the inorganic particulate materials and particulate resins improves pulverizability as well as transferability and durability although improving less than a toner externally including them. When the external and internal additives are used together, the burial of the external additives in mother toner particles can be prevented and the resultant toner stably has good transferability and durability.

Specific examples of the hydrophobizer include dimethyldichlorosilane, trimethylchlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxylsilane, vinyltriethoxysilane, vinylmethoxysilane, vinyl-tris(β-methoxyethoxy)silane, γ-methacryloxypropyltrimethoxysilane, vinyltriacetoxysilane, divinyldichlorosilane, dimethylvinylchlorosilane, octyl-trichlorosilane, decyltrichlorosilane, nonyl-trichlorosilane, (4-tert-propylphenyl)-trichlorosilane, (4-tert-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-tert-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-tert-propylphenyl)-diethyl-chlorosilane, octyltrimethoxysilane, hexamethyldisilazane, hexaethyldisilazane, hexatolyldisilazane, etc. Besides these agents, titanate coupling agents and aluminium coupling agents can be used. Besides, as an external additive for the purpose of improving cleanability, lubricants such as a particulate fatty acid metal salt and polyvinylidene fluoride can be used.

The toner can be prepared by known methods such as a pulverization method and a polymerization method. In the pulverization method, as apparatuses for melting and kneading a toner, a batch type two-roll kneading machine, a Bumbury's mixer, a continuous biaxial extrusion machine such as KTK biaxial extrusion machines from Kobe Steel, Ltd., TEM biaxial extrusion machines from Toshiba Machine Co., Ltd., TEX biaxial extrusion machines from Japan Steel Works, Ltd., PCM biaxial extrusion machines from Ikegai Corporation and KEX biaxial extrusion machines from Kurimoto, Ltd. and a continuous one-axis kneading machine such as KO-KNEADER from Buss AG are preferably used.

The melted and kneaded materials thereby are cooled and pulverized. A hammer mill, rotoplex, etc. crush the cooled materials, and jet stream and mechanical pulverizers pulverize the crushed materials to preferably have an average particle diameter of from 3 to 15 μm. Further, the pulverized materials are classified into the materials having particle diameters of from 5 to 20 μm by a wind-force classifier, etc.

Next, an external additive is preferably added to mother toner particles. The external additive and mother toner particles are mixed and stirred by a mixer such that the external additive covers the surface of the mother toner particles while pulverized. It is essential that the external additives such as inorganic particulate materials and particulate resins are uniformly and firmly fixed to the mother toner particles improve durability of the resultant toner. This is simply an example and the method is not limited thereto.

Figure 2:
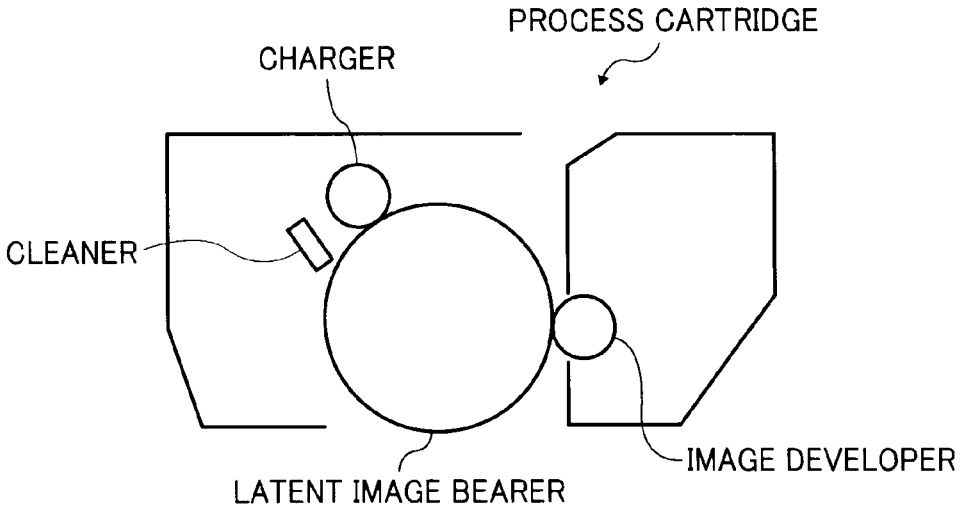
FIG. 2 is a schematic view illustrating an embodiment of the process cartridge of the present invention.

FIG. 2 is a schematic view illustrating an embodiment of the process cartridge of the present invention. In FIG. 2, the process cartridge includes a latent image bearer (photoreceptor), a charger, an image developer and a cleaner.

In the present invention, the process cartridge includes at least the latent image bearer, and the image developer among the above-mentioned constitutional elements such as the latent image bearer, the charger, the image developer and the cleaner in a body, which is detachable from an image forming apparatus such as copiers and printers. The image developer includes the developer of the present invention.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

The following materials were mixed by a homomixer for 10 min to prepare a solution for forming a coated layer.

| | |
|---|---|
| Acrylic resin solution (a solid content: 50% by weight) | 70 |
| Guanamine solution (a solid content: 70% by weight) | 20 |
| Acidic catalyst (a solid content: 40% by weight) | 1 |
| Silicon resin solution (a solid content: 20% by weight) | 350 |
| Aminosilane (a solid content: 100% by weight) | 5 |
| Conductivized particulate titanium oxide (Surface: ITO treated, Primary particle diameter: 50 nm, Specific volume resistivity; $1.0 \times 10^2\ \Omega \cdot cm$) | 165 |
| Toluene | 700 |

Next, the solution was coated on a core material formed of Cu—Zn ferrite having an average particle diameter of 35 μm and a saturated magnetization of 42 $Am^2/kg$ by SPIRA COTA from OKADA SEIKO CO., LTD to form a layer having a thickness of 0.15 μm on the surface of the core material, and dried.

The thus prepared coated carrier was left on the inside of a three-roll coil having a hollow conductive wire diameter of 6 mm, and the coil was electrified at an electric power of 5 kW and an electric current of 400 A, to burn the carrier at 160° C. The hollow conductive wire has a thickness of 1 mm and an inner diameter of 4 mm, cooling water was flowed through the wire to cool the wire heated by a high-frequency induction current. JOTSHOT5 (6 kW) from AMBRELL was used as a high-frequency induction current transmitter. The burned carrier was cooled and sifted by a sieve having an opening of 63 μm to prepare a [carrier 1].

Among the following materials, a colorant, a binder resin and pure water were mixed at a ratio of 1:1:0.5 by a two-roll to prepare a mixture.

| | |
|---|---|
| Polyester resin | 100 |
| Carnauba wax | 5 |
| Charge controlling agent E-84 from Orient Chemical Industries, Ltd. | 1 |
| C.I. Pigment Yellow 180 | 8 |

The mixture was kneaded at 70° C. thereby, and roll temperature was increased to 120° C. and water was vapored to preliminarily prepare a masterbatch. The masterbatch was mixed by HENSCHEL MIXER with the other remaining materials so as to have the above-mentioned formulation, and the mixture was melted and kneaded with a two-roll mill at 120° C. for 40 min to prepare a kneaded mixture. The kneaded mixture was cooled and hardened to prepare a hardened mixture. The hardened mixture was crushed with a hammer mill and pulverized with an air jet pulverizer to prepare a pulverized mixture. The pulverized mixture was classified to prepare mother toner particles having a weight-average particle diameter of 5 μm.

Further, each 1 part of hydrophobized silica and hydrophobized titanium oxide were mixed by HENSCHEL MIXER with 100 parts of the mother toner particles to prepare a yellow toner [toner 1].

7 parts of the [toner 1] and 93 parts of the [carrier 1] were mixed to prepare a developer having a toner concentration of 7% by weight.

Example 2

The procedure for preparation of the [carrier 1] in Example 1 was repeated to prepare a [carrier 2] except for replacing the core material with a core material formed of Mn—Mg ferrite having saturated magnetization of 75 $Am^2/kg$. The procedure for preparation of the developer in Example 1 was repeated to prepare a developer except for replacing the [carrier 1] with the [carrier 2].

Example 3

The procedure for preparation of the [carrier 1] in Example 1 was repeated to prepare a [carrier 3] except for replacing the core material with a core material formed of Mn ferrite having saturated magnetization of 80 $Am^2/kg$. The procedure for preparation of the developer in Example 1 was repeated to prepare a developer except for replacing the [carrier 1] with the [carrier 3].

Example 4

The procedure for preparation of the [carrier 1] in Example 1 was repeated to prepare a [carrier 4] except for replacing the core material with a core material formed of magnetite having saturated magnetization of 90 $Am^2/kg$. The procedure for preparation of the developer in Example 1 was repeated to prepare a developer except for replacing the [carrier 1] with the [carrier 4].

Comparative Example 1

The procedure for preparation of the [carrier 1] in Example 1 was repeated to prepare a [carrier 5] except for replacing the core material with a core material formed of Cu—Zn ferrite having saturated magnetization of 38 $Am^2/kg$. The procedure for preparation of the developer in Example 1 was repeated to prepare a developer except for replacing the [carrier 1] with the [carrier 5].

Comparative Example 2

The procedure for preparation of the [carrier 1] in Example 1 was repeated to prepare a [carrier 6] except for replacing the core material with a core material formed of magnetite having saturated magnetization of 97 $Am^2/kg$. The procedure for preparation of the developer in Example 1 was repeated to prepare a developer except for replacing the [carrier 1] with the [carrier 6].

The initial carrier adherence, anti-solidification and color contamination resistance of the developers prepared in Examples 1 to 3 and Comparative Examples 1 and 2 were evaluated. The evaluation results are shown in Table 1.

Method of evaluating the carriers are as follows.

[Initial Carrier Adherence]

The developer was set in a marketed and modified full-color printer imagio MP C5000 from Ricoh Company, Ltd to evaluate carrier adherence. The background potential was fixed at 150 V and 5 solid A3 images were produced to observe with a loupe. Excellent when an average number of white blank images and the carrier adhering to the image is 0. Good when 1 to 5, passable when 6 to 10, and poor when not less than 11. Excellent, good and passable were acceptable, and poor was rejectable.

[Anti-Solidification]

An A4 halftone solid image was produced to see solidification of the developer in the developing unit. When solidified, the developer stays behind the doctor blade, causing stripe images, which are ranked as below.

The developer was set in a sealed developer hopper of a modified developing unit of a marketed digital full-color printer IPSiO CX 8200 from Ricoh Company, Ltd. so as not to fall in a stirrer, and the developer hopper was set in the printer and left in an environmental test laboratory at 55° C., 95% RH for 48 hrs. When leaving the developer in the environmental test laboratory, the temperature and humidity need gradually increasing to 55° C., 95% RH. 48 hrs later, the developer was taken out and left for 2 hrs or more in a thermoneutral environment. The developing unit should not be oscillated because the solidified developer breaks, which largely influence on he evaluation result.

The seal separating the developer hopper and the developing unit stirrer was drawn such that the developer falls into the stirrer. When not solidified, the developer smoothly falls in the stirrer. When badly solidified, the developer does not. After the initial setting of the printer was executed, an A4 halftone solid image was produced and ranked as follows.

Excellent: Initializable and a quality halftone image was produced

Good: Initializable, but a stripe image is lightly observed

Poor: Initializable, but a stripe image is clearly observed

Worst: The developer less or never falls and uninitializable, practically unusable.

Excellent and Good are acceptable, of course. Poor and Worst are rejectable.

[Color Contamination]

The developer was set in a developing unit of a marketed and modified full-color printer imagio MP C5000 from Ricoh Company, Ltd., and the developer was stirred for 1 hr by the developing unit alone. Images were developed and fixed with the developer, and L*1, a*1 and b*1 values of the CIE color system of a part having an image density of 1.5 were measured by X-Rite 938 from X-Rite, Inc.

Meanwhile, images were developed and fixed with a toner alone without contacting a carrier to produce images having no color contamination, and L*0, a*0 and b*0 values of the CIE color system of a part having an image density of 1.5 were measured as above. A color difference ΔE determined by the following formula between the two images were evaluated as follows.

$$\Delta E=[(L^*0-L^*1)^2+(a^*0-a^*1)^2+(b^*0-b^*1)^2]^{1/2}$$

ΔE≤1.0: Excellent 1.0<ΔE≤2.0: Good

ΔE>2.0: Poor

Excellent and Good are acceptable. Poor is rejectable.

[Abrasion Resistance]

The developer was set in a developing unit of a marketed and modified full-color printer imagio MP C5000 from Ricoh Company, Ltd., and the developer was stirred for 190 hrs by the developing unit alone. After a carrier and a toner of the developer were separated by a blower, adherence amounts of an Si element and an Al element in a coated layer of the carrier were measured by florescent X-ray. Residual ratios thereof ΔSi and ΔA1 were determined by the following formulae.

100≥ΔSi>80: Excellent

80≥ΔSi>75: Good

75≥ΔSi>70: Passable

ΔSi≤70: Poor

Excellent, Good and Passable are acceptable. Poor is rejectable.

100≥ΔAl>90: Excellent

90≥ΔAl>80: Good

80≥ΔAl>70: Passable

ΔAl≤70: Poor

Excellent, Good and Passable are acceptable. Poor is rejectable.

ΔSi [%]=100×Adherence amount of Si before stirred−Adherence amount of Si after stirred/Adherence amount of Si before stirred (1)

ΔAl [%]=100×Adherence amount of Al before stirred−Adherence amount of Al after stirred/Adherence amount of Al before stirred (2)

TABLE 1

| | Initial carrier adherence | solidification | Color contamination | ΔSi | ΔAl |
|---|---|---|---|---|---|
| Example 1 | Passable | Good | Excellent | Passable | Passable |
| Example 2 | Good | Excellent | Excellent | Good | Good |
| Example 3 | Excellent | Excellent | Excellent | Good | Good |
| Example 4 | Good | Excellent | Excellent | Excellent | Excellent |
| Comparative Example 1 | Passable | Passable | Excellent | Poor | Poor |
| Comparative Example 2 | Poor | Excellent | Excellent | Excellent | Excellent |

As Table 1 shows, the developers prepared in Examples 1 to 4 are apparently better than those prepared in Comparative Examples 1 to 2 in initial carrier adherence, anti-solidification, color contamination resistance and abrasion resistance.

Having now fully described the invention, it will be apparent to one of ordinary skill in the art that many changes and modifications can be made thereto without departing from the spirit and scope of the invention as set forth therein.

What is claimed is:

1. A method of preparing a carrier for electrophotography, comprising a magnetic core material and a coating material layer formed on the surface of the magnetic core material, comprising:

coating the magnetic core material with the coating material, wherein the coating material comprises a solvent; and burning the coating material with a high-frequency induction heater to form the coating material layer on the surface of the magnetic core material, wherein the high-frequency induction heater generates an alternating magnetic field and the alternating magnetic field repeatedly magnetizes the core material (hysteresis loss), and wherein the high-frequency induction heater heats the coating material on the surface of the magnetic core material from the inside so that solvent is removed from the coating material on the surface of the coating material and the coating material on the surface of the magnetic core material is crosslinked, and wherein the magnetic core material has a saturated magnetization of from 40 to 95 $Am^2/kg$.

2. The method of claim 1, wherein the magnetic core material is a member selected from the group consisting of magnetite, Mn ferrite, Mn-Mg ferrite and Cu-Zn ferrite.

3. The method of claim 1, wherein the coating material layer on the surface of the magnetic core material comprises a silicone resin.

4. The method of claim 1, wherein the coating material layer on the surface of the magnetic core material comprises a fluorine-containing resin.

5. The method of claim 1, wherein the coating material layer on the surface of the magnetic core material comprises an acrylic resin.

* * * * *